US005416162A

United States Patent [19]

Gore et al.

[11] Patent Number: 5,416,162

[45] Date of Patent: May 16, 1995

[54] COMPATIBILIZER FOR A VISCOSITY INDEX IMPROVING POLYMER BLEND

[75] Inventors: Robert H. Gore, Southampton; Chung Y. Lai, Plymouth Meeting, both of Pa.

[73] Assignee: Rohm and Haas Company, Philadelphia, Pa.

[21] Appl. No.: 124,233

[22] Filed: Sep. 20, 1993

[51] Int. Cl.[6] ..... C08L 51/06; C10M 145/14

[52] U.S. Cl. ..... 525/79; 525/80; 525/303; 252/56 R

[58] Field of Search ..... 525/303, 309, 223, 79, 525/80; 252/56 R

[56] References Cited

U.S. PATENT DOCUMENTS 4,149,984 4/1979 Wenzel .
4,229,311 10/1980 Wenzel .
4,282,132 8/1981 Benda .
4,290,925 9/1981 Pennewiss .
4,611,031 9/1986 Galluccio .
4,822,508 4/1989 Pennewiss et al. ..... 252/56 R
5,188,770 2/1993 Pennewiss .
5,312,884 5/1994 Gore et al. ..... 526/328
5,368,761 11/1994 Gore ..... 252/56

FOREIGN PATENT DOCUMENTS 3001045 7/1981 Germany .
418610 9/1989 Germany .

*Primary Examiner*—Vasu S. Jagannathan

[57] ABSTRACT

A method for making compatibilizer for a concentrated viscosity index improving polymer blend includes polymerizing a mixture of (meth)acrylate monomers in the presence of a polyolefin polymer. A concentrated blend of viscosity index improving polymers includes a nonnitrogenous dispersant poly(meth)acrylate copolymer, a polyolefin copolymer, the compatibilizer and a hydrocarbon diluent.

5 Claims, No Drawings

COMPATIBILIZER FOR A VISCOSITY INDEX IMPROVING POLYMER BLEND

TECHNICAL FIELD

The present invention relates to viscosity index improving additives for lubricating oils and, more particularly, to a method for making a compatibilizer for a concentrated viscosity index improving blend of a poly(meth)acrylate copolymer and a polyolefin copolymer.

BACKGROUND OF THE INVENTION

Lubricating oil compositions for internal combustion engines typically include polymeric additives for improving the viscosity index of the lubricating composition, that is, modifying the relationship between temperature and the viscosity of the oil composition to reduce the temperature dependence of the viscosity, to lower the "pour point" of the composition, that is, to allow the composition to remain fluid at reduced temperature, and to provide "dispersant" properties, that is, to allow sludge particles to remain suspended in the oil composition.

Poly(alkyl methacrylate) (PMA) copolymeric additives and olefinic copolymer (OCP) additives are two classes of copolymers that are used as viscosity index improvers in lubricating oils. In general, PMA additives provide better low temperature performance than OCP additives, while OCP additives provide higher thickening efficiency than PMA additive, so that relatively less OCP additive is required to provide an equivalent thickening effect in the oil composition.

Dispersant properties may be imparted to PMA additives by incorporating monomeric units derived from nitrogenous comonomers into the copolymer, and may be imparted to OCP additives by grafting nitrogenous branches onto the OCP backbone. Some nitrogenous dispersant additives have been found to degrade fluoropolymer gaskets and seals. Since fluoropolymer gaskets and seals are enjoying increased acceptance in the automotive industry, there is a growing interest in non-nitrogenous dispersant additives.

PMA/OCP blends which provide a balance of the desirable properties of each type of additive are known. Coassigned U.S. Pat. No. 4,622,031 discloses concentrated blends of a nitrogen-containing PMA, an OCP and a "compatibilizer" graft copolymer having PMA branches grafted onto an OCP backbone, each dissolved in a hydrocarbon fluid. The compatibilizer copolymer stabilizes the thermodynamically incompatible PMA and OCP additives to discourage separation of the blend into discrete phases. U.S. Pat. No. 5,188,770 discloses a concentrated emulsion including a poly(alkyl methacrylate) copolymer and an olefin copolymer wherein alkyl methacrylate monomers are polymerized in an oil compatible liquid vehicle in the presence of an olefin polymer, hydrogenated isoprene, a hydrogenated butadiene-styrene copolymer, hydrogenated polyisoprene or hydrogenated polybutadiene.

While perhaps deceptively simple in theory, the development of a compatibilizer for stabilizing concentrated viscosity index improving blends of PMA and OCP copolymers is, in practice, a highly empirical undertaking.

SUMMARY OF THE INVENTION

A method for making a compatibilizer for a viscosity index improving blend of a poly(meth)acrylate copolymer and a polyolefin copolymer is disclosed. The method includes:

polymerizing, in an oil soluble diluent and in the presence of an olefin copolymer, a monomer mixture comprising:

from about 0 weight percent to about 40 weight percent of a first monomer having the structural formula:

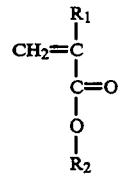

wherein:

each $R_1$ is independently H or $CH_3$; and each $R_2$ is independently selected from $(C_1-C_6)$alkyl;

about 30 weight percent to about 90 weight percent of a second monomer having the structural formula:

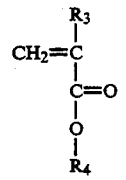

wherein:

each $R_3$ is independently H or $CH_3$; and each $R_4$ is independently selected from $(C_7-C_{15})$alkyl;

from about 0 weight percent to about 40 weight percent of a third monomer having the structural formula:

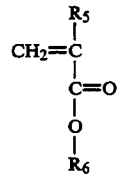

wherein each $R_5$ is independently H or $CH_3$; and each $R_6$ is independently selected from $(C_{16}-C_{24})$alkyl; and from about 2 weight percent to about 10 weight percent of a fourth monomer having the structural formula:

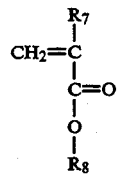

wherein each $R_7$ is independently H or $CH_3$; and each $R_8$ is independently selected from $(C_1-C_6)$hydroxyalkyl.

A polymer blend includes:

an oil soluble diluent; and about 30 weight percent to about 50 weight percent polymer solids dispersed in the diluent, said polymer solids comprising:

from about 1 part by weight to about 20 parts by weight of an oil soluble olefinic copolymer;

from about 1 part by weight to about 20 parts by weight of the above described compatibilizer; and from about 20 parts by weight to about 60 parts by weight of an oil soluble alkyl (meth)acrylate copolymer, wherein the alkyl (meth)acrylate copolymer includes:

from about 0 weight percent to about 40 weight percent first repeating units derived from a monomer having the structural formula:

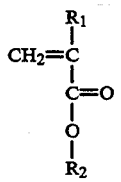

wherein each $R_1$ is independently H or $CH_3$; and each $R_2$ is independently selected from $(C_1-C_6)$alkyl;

from about 30 weight percent to about 90 weight percent second repeating units derived from a monomer having the structural formula:

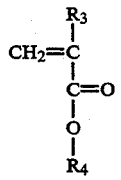

wherein each $R_3$ is independently H or $CH_3$; and each $R_4$ is independently selected from $(C_7-C_{15})$alkyl;

from about 0 weight percent to about 40 weight percent third repeating units derived from a monomer having the structural formula:

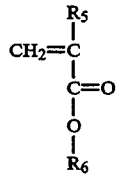

wherein each $R_5$ is independently H or $CH_3$; and each $R_6$ is independently selected from $(C_{16}-C_{24})$alkyl; and from 2 weight percent to about 10 weight percent fourth repeating units derived from a monomer having the structural formula:

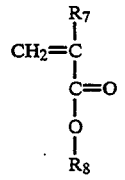

wherein each $R_7$ is independently H or $CH_3$; and each $R_8$ is independently selected from $(C_1-C_6)$hydroxyalkyl;

wherein the weight percent of fourth monomer in the compatibilizer monomer mixture is within 5 weight percent of the weight percent of fourth monomeric units in the alkyl (meth)acrylate copolymer.

DETAILED DESCRIPTION OF THE INVENTION

The compatibilizer of the present invention includes a (meth)acrylate portion and a polyolefin portion. As used herein the terms "(meth)acrylate" and "poly(meth-)acrylate" refer collectively to acrylate and methacrylate compounds. The compatibilizer is useful for stabilizing a concentrated blend of otherwise thermodynamically incompatible viscosity index improving copolymers, that is, a concentrated blend of an oil soluble poly(meth)acrylate copolymer and an oil soluble polyolefin copolymer. The concentrated polymer blend is useful as a viscosity improving additive for lubricating oil compositions.

The poly(meth)acrylate copolymer of the polymer blend of the present invention includes repeating units derived from alkyl (meth)acrylate and hydroxyalkyl (meth)acrylate monomers.

The poly(meth)acrylate copolymer of the polymer blend of the present invention includes from about 0 weight percent (wt %) to about 40 wt % first repeating units, wherein each first repeating unit is derived from a monomer having structural formula (1):

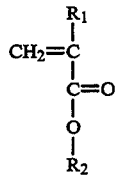

(1)

wherein:

each $R_1$ is independently H or $CH_3$; and each $R_2$ is independently selected from $(C_1-C_6)$alkyl.

In a preferred embodiment, $R_1$ is $CH_3$.

As used herein, $(C_1-C_6)$alkyl means any straight or branched alkyl group having 1 to 6 carbon atoms per group, e.g., methyl, ethyl, n-propyl, isopropyl, n-butyl, isobutyl, t-butyl, isopentyl, hexyl. In a preferred embodiment, $R_2$ is selected from the group consisting of methyl, n-butyl, isobutyl and mixtures thereof. Most preferably, $R_2$ is methyl.

Monomers having the structural formula (1) include, for example, methyl methacrylate, ethyl methacrylate, propyl methacrylate, butyl methacrylate, isopentyl methacrylate and mixtures thereof. In a preferred embodiment, the monomer having the structural formula (1) is methyl methacrylate, butyl methacrylate or a mixture thereof.

The poly(meth)acrylate copolymer of the polymer blend of the present invention includes from about 30 weight percent (wt %) to about 90 wt % second repeating units, wherein each second repeating unit is derived from a monomer having structural formula (2):

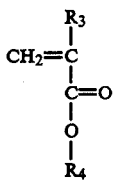

(2)

wherein:

each $R_3$ is independently H or $CH_3$; and each $R_4$ is independently selected from $(C_7-C_{15})$alkyl.

In a preferred embodiment, $R_3$ is $CH_3$.

As used herein, $(C_7-C_{15})$ alkyl means any straight or branched alkyl group having 7 to 15 carbon atoms per group, e.g., heptyl, octyl, nonyl, decyl, isodecyl, undecyl, lauryl, tridecyl, myristyl, pentadecyl. In a preferred embodiment, $R_4$ is (C10–C15)alkyl. More preferably, $R_4$ is selected from the group consisting of isodecyl, lauryl, tridecyl, myristyl, pentadecyl and mixtures thereof.

Monomers having the structural formula (2) include, for example, octyl methacrylate, nonyl methacrylate, decyl methacrylate, isodecyl methacrylate, undecyl methacrylate, lauryl methacrylate, tridecyl methacrylate, myristyl methacrylate, pentadecyl methacrylate and mixtures thereof. In a preferred embodiment, the monomer having the structural formula (2) is isodecyl methacrylate, undecyl methacrylate, lauryl methacrylate, tridecyl methacrylate, myristyl methacrylate, pentadecyl methacrylate or a mixture thereof.

The poly(meth)acrylate copolymer of the polymer blend of the present invention includes from about 0 weight percent (wt %) to about 40 wt % third repeating units, wherein each third repeating unit is derived from a monomer having structural formula (3):

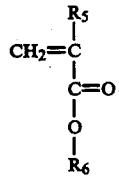

(3)

wherein:

each $R_5$ is independently H or $CH_3$; and each $R_6$ is independently selected from $(C_{16}-C_{24})$alkyl.

In a preferred embodiment, $R_5$ is $CH_3$.

As used herein, $(C_{16}-C_{24})$ alkyl means any straight or branched alkyl group having 16 to 24 carbon atoms per group, e.g., stearyl, cetyl, heptadecyl, nonadecyl, eicosyl. In a preferred embodiment, $R_6$ is $(C_{16}-C_{20})$alkyl. In a more highly preferred embodiment, $R_6$ is selected from the group consisting of stearyl, cetyl, eicosyl and mixtures thereof.

Monomers having the structural formula (3) include, for example, stearyl methacrylate, cetyl methacrylate, heptadecyl methacrylate, nonadecyl methacrylate, eicosyl methacrylate and mixtures thereof.

The poly(meth)acrylate copolymer of the polymer blend of the present invention includes from about 2 weight percent (wt %) to about 10 wt % fourth repeating units, wherein each fourth repeating unit is derived from a monomer having structural formula (4):

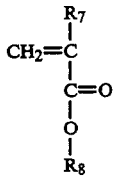

(4)

wherein:

each $R_7$ is independently H or $CH_3$; and each $R_8$ is independently selected from $(C_2-C_6)$hydroxyalkyl.

In a preferred embodiment, $R_7$ is $CH_3$.

As used herein, $(C_2-C_6)$ hydroxyalkyl means any straight or branched hydroxyalkyl group having 1 to 6 carbon atoms per group, e.g., 2-hydroxyethyl, 2-hydroxypropyl, 1-methyl 2-hydroxyethyl, 2-hydroxybutyl. In a preferred embodiment, $R_8$ is 2-hydroxyethyl, 2-hydroxypropyl or a mixture thereof.

Monomers having the structural formula (4) include, for example, 2-hydroxyethyl acrylate, 2-hydroxyethyl methacrylate, 2-hydroxypropyl acrylate, 2-hydroxypropyl methacrylate, 1-methyl 2-hydroxyethyl acrylate, 1-methyl 2-hydroxyethyl methacrylate, 2-hydroxybutyl acrylate, 2-hydroxybutyl methacrylate and mixtures thereof. In a preferred embodiment, the monomer having the structural formula (4) 2-hydroxyethyl methacrylate, 2-hydroxypropyl methacrylate or a mixture thereof. In a more highly preferred embodiment, the monomer having the structural formula (4) is 2-hydroxypropyl methacrylate.

The polar hydroxyalkyl moieties of the monomer of structural formula (4) provide dispersant properties to the poly(meth)acrylate copolymer.

To provide the desired oil solubility, the average number of carbons per group of the combined alkyl and hydroxyalkyl groups of the poly(meth)acrylate copolymer of the polymer blend of the present invention is between about 7 and about 12.

In a preferred embodiment, the average number of carbon atoms per alkyl or hydroxyalkyl group of the poly(meth)acrylate copolymer of the polymer blend of the present invention is between 8 and 10.

In a preferred embodiment, the poly(meth)acrylate copolymer of the polymer blend of the present invention includes about 0 wt % to about 25 wt %, more preferably, about 2 wt % to about 10 wt %, repeating units derived from a monomer having the structural formula (1).

In a preferred embodiment, the poly(meth)acrylate copolymer of the polymer blend of the present invention includes about 35 wt % to about 85 wt %, more preferably, about 45 wt % to about 65 wt %, repeating units derived from a monomer having the structural formula (2).

In a preferred embodiment, the poly(meth)acrylate copolymer of the polymer blend of the present invention includes about 5 wt % to about 35 wt %, more preferably, about 15 wt % to about 35 wt %, repeating units derived from a monomer having the structural formula (3).

In a preferred embodiment, the poly(meth)acrylate copolymer of the polymer blend of the present invention includes about 2 wt % to about 8 wt %, more preferably, about 4 wt % to about 6 wt %, repeating units derived from a monomer having the structural formula (4).

In a highly preferred embodiment, the poly(meth)acrylate copolymer of the polymer blend of the present invention includes from about 2 wt % to about 10 wt % repeating units derived from a monomer having the structural formula (1), from about 45 wt % to about 65 wt % repeating units derived from a monomer having the structural formula (2), from about 15 wt % to about 35 wt % repeating units derived from a monomer having the structural formula (3) and from about 4 wt % to about 6 wt % repeating units derived from a monomer having the structural formula (4).

The poly(meth)acrylate copolymer of the polymer blend of the present invention has a weight average molecular weight, determined, e.g., by gel permeation chromatography, from about 100,000 to about 1,000,000 and a polydispersity factor, i.e., a ratio of number average molecular weight to weight average molecular weight of about 1.5 to about 15. In a more highly preferred embodiment, the poly(meth)acrylate copolymer has a weight average molecular weight from about 300,000 to about 800,000 and a polydispersity index of about 2 to 4.

The poly(meth)acrylate copolymer of the polymer blend of the present invention can be made by free radical initiated polymerization of the above-disclosed alkyl (meth)acrylate monomers.

The polyolefin copolymer of the polymer blend of the present invention is an oil soluble olefin copolymer (OCP). OCPs suitable as the polyolefin copolymer include oil soluble polymers derived from alpha-olefin monomers having from two to twenty carbon atoms per monomer molecule. Suitable OCPs include, for example, oil soluble hydrogenated poly(isoprene), hydrogenated poly(butadiene), ethylene-propylene copolymers, hydrogenated styrene-butadiene copolymers, styrene-isoprene copolymers and ethylene-propylene-diene terpolymers.

In a preferred embodiment, the polyolefin copolymer of the polymer blend of the present invention exhibits a weight average molecular weight of about 10,000 to about 3,000,000. In a more highly preferred embodiment, the polyolefin copolymer exhibits a weight average molecular weight of about 25,000 to about 2,000,000.

The compatibilizer of the present invention includes an polyolefin portion and a poly(meth)acrylate portion and is believed to include a graft copolymer wherein one or more poly(meth)acrylate branches are grafted onto a polyolefin backbone.

The compatibilizer of the present invention is made by conventional free radical initiated polymerization of a mixture of the above disclosed (meth)acrylate monomers ("compatibilizer monomer mixture") in an oil soluble hydrocarbon diluent and in the presence of a polyolefin substrate.

In a preferred embodiment, the oil soluble diluent is a paraffinic or naphthenic neutral oil.

The polyolefin substrate is an oil soluble olefin copolymer. Oil soluble olefin copolymers suitable as the polyolefin substrate include those oil soluble olefin copolymers disclosed above as being suitable as the polyolefin copolymer of the blend of the present invention.

In a preferred embodiment, the polyolefin substrate used to make the compatibilizer of the present invention and the polyolefin copolymer of the blend of the present invention are substantially identical, that is, are of substantially the same composition and of substantially the same molecular weight.

In a preferred embodiment, the compatibilizer is made by free radical initiated polymerization of about 80 parts by weight (pbw) to 99 pbw of the compatibilizer monomer mixture and about 1 pbw to 20 pbw polyolefin substrate.

In a preferred embodiment, the reaction mixture includes about 40 pbw to about 250 pbw hydrocarbon diluent per 100 pbw compatibilizer (on a polymer solids basis, that is, per 100 pbw of the polymer solids of the combined poly(meth)acrylate and polyolefin portions of the compatibilizer).

The compatibilizer monomer mixture includes about 0 wt % to about 40 wt % (meth)acrylate monomer of the structural formula (1), about 30wt % to about 90wt % (meth)acrylate monomer of the structural formula (2), about 0 wt % to about 40 wt % (meth)acrylate monomer of the structural formula (3) and about 2 wt % to about 10 wt % (meth)acrylate monomer of the structural formula (4).

In a preferred embodiment, the compatibilizer monomer mixture includes about 0 wt % to about 25 wt %, more preferably, about 2 wt % to about 10 wt %, monomer of the structural formula (1).

In a preferred embodiment, the compatibilizer monomer mixture includes about 35 wt % to about 85 wt %, more preferably, about 45 wt % to about 65 wt %, monomer of the structural formula (2).

In a preferred embodiment, the compatibilizer monomer mixture includes about 5 wt % to about 35 wt %, more preferably, about 15 wt % to about 35 wt %, monomer of the structural formula (3).

In a preferred embodiment, the compatibilizer monomer mixture includes about 2 wt % to about 8 wt %, more preferably, about 4 wt % to about 6 wt %, a monomer of the structural formula (4).

In a highly preferred embodiment, the compatibilizer monomer mixture includes about 2 wt % to about 10 wt % monomer having the structural formula (1), about 45 wt % to about 65 wt % monomer having the structural formula (2), about 15 wt % to about 35 wt % monomer having the structural formula (3) and about 4 wt % to about 6 wt % monomer having the above-disclosed structural formula (4).

Each of the above described copolymers of the polymer blend of the present invention, that is, the poly(meth)acrylate copolymer, the polyolefin copolymer and the compatibilizer may, optionally, be synthesized at a molecular weight that is higher than desired for the intended end use and then be mechanically or thermally degraded to adjust the molecular weight of the copolymer into the desired range, in a manner known in the art.

In a preferred embodiment of the present invention, the compatibilizer and the poly(meth)acrylate copolymer are synthesized separately and then combined with the polyolefin copolymer and a hydrocarbon diluent to form a concentrated blend.

In an alternative embodiment of the present invention, the compatibilizer and the poly(meth)acrylate copolymer are synthesized simultaneously in the presence of the polyolefin copolymer and the composition of the product mixture so produced is adjusted, for example, by adding hydrocarbon diluent, to form a concentrated polymer blend of the desired composition.

The concentrated polymer blend of the present invention includes an oil soluble hydrocarbon diluent and about 30 weight percent to about 70 weight percent polymer solids dissolved in the diluent, wherein the polymer solids include from about 1 pbw to about 30 pbw poly(meth)acrylate copolymer, from about 1 pbw to about 2 pbw oil soluble polyolefin copolymer, from about 1 pbw to about 3 pbw compatibilizer polymer solids.

In a preferred embodiment, the concentrated polymer blend includes about 40 weight percent to about 60 weight percent polymer solids.

In a preferred embodiment, the polymer solids of the concentrated polymer blend include from about 2 pbw to about 10 pbw poly(meth)acrylate copolymer, from about 1 pbw to about 2 pbw oil soluble polyolefin copolymer, from about 1 pbw to about 2.5 pbw compatibilizer polymer solids.

To provide a concentrated polymer blend having improved thermodynamic stability, it is critical that the relative composition of the monomer mixture used in the compatibilizer polymerization reaction closely approach the composition of the poly(meth)acrylate copolymer.

The weight percent of monomer having the structural formula (4) in the compatibilizer monomer mixture is within 5 weight percent, more preferably, within 4 weight percent, and most preferably, within 2 weight percent, of the weight percent of repeating units derived from monomer of the structural formula (4) in the alkyl (meth)acrylate copolymer of the polymer blend of the present invention. For example, in a embodiment, if 5 weight percent of the repeating units in the alkyl (meth)acrylate copolymer are derived from monomer of the structural formula (4), then the compatibilizer monomer mixture includes 3 weight percent to 7 weight percent monomer of the structural formula (4).

In a preferred embodiment, the weight percent of monomer having the structural formula (4) in the compatibilizer monomer mixture and the weight percent repeating units derived from monomer having the structural formula (4) in the alkyl (meth)acrylate copolymer of the polymer blend of the present invention are substantially identical.

In a highly preferred embodiment, the average number of carbon atoms in the alkyl and hydroxyalkyl substituents of the monomers of the compatibilizer monomer mixture agrees with the average number of carbon atoms in the alkyl and hydroxyalkyl substituents of the poly(meth)acrylate copolymer of the polymer blend of the present invention within about ±0.5. For example, in a preferred embodiment, if the average number of carbon atoms in the alkyl and hydroxyalkyl substituents of the poly(meth)acrylate copolymer of the polymer blend is 9, then the average number of carbon atoms in the alkyl and hydroxyalkyl substituents of the monomers of the compatibilizer monomer mixture is about 8.5 to about 9.5.

In a more highly preferred embodiment, the average number of carbon atoms in the alkyl and hydroxyalkyl substituents of the monomers of the compatibilizer monomer mixture agrees with the average number of carbon atoms in the alkyl and hydroxyalkyl substituents of the poly(meth)acrylate copolymer of the polymer blend of the present invention within about ±0.1.

In an even more highly preferred embodiment, the relative composition of the compatibilizer monomer mixture is substantially identical to the relative composition of repeating units of the poly(meth)acrylate copolymer of the polymer blend of the present invention.

The concentrated polymer blend of the present invention is useful as a viscosity improving additive for lubricating oil compositions.

A lubricating oil composition of the present invention includes from about 2 pbw to about 20 pbw of the concentrated blend of the present invention and from about 80 pbw to about 98 pbw of a base oil. Suitable base oils include paraffinic and naphthenic neutral oils.

In a more highly preferred embodiment, the lubricating oil composition of the present invention includes from about 3 pbw to about 15 pbw of the concentrated blend of the present invention and from about 85 pbw to about 97 pbw of a lubricating oil.

EXAMPLE 1

A compatibilizer of the present invention was made wherein the poly(meth)acrylate monomer mixture included 30 wt % cetyl-eicosyl methacrylate, 55 wt % isodecyl methacrylate, 10 wt % methyl methacrylate and 5 wt % hydroxypropyl methacrylate.

A 1 liter reaction vessel was fitted with a thermometer, a temperature controller, a purge gas inlet, a water-cooled reflux condenser with purge gas outlet, a stirrer, and an addition funnel. To the reaction vessel was charged 639.87 grams of a mixture of 113.09 pbw cetyl-eicosyl methacrylate (95.5% purity), 205.71 pbw isodecyl methacrylate (98% purity), 32.40 pbw methyl methacrylate (100% purity), 18.0 pbw hydroxypropyl methacrylate (100% purity) and 270.67 pbw of a solution of 15 wt % ethylene/propylene copolymer in oil (ECA-6941, Paramins). The reaction vessel was then flushed with nitrogen and the contents of the vessel were heated to 105° C. When the contents of the vessel reached 105° C., an initiator solution, consisting of 6.00 pbw of a 50% solution of t-butyl peroctoate in mineral spirits (Lupersol PMS) and 40.00 pbw paraffinic neutral oil (100N oil) was started. 46.00 grams of the initiator solution was fed to the reaction vessel at a uniform rate over a 120 minute time period. The reaction vessel was cooled as necessary during the initiator addition to maintain the reaction temperature at 105° C. The reaction vessel contents were maintained at 105° C. for 30 minutes following completion of the initiator feed. Three discrete shots of initiator, each consisting of 4.40 g of a mixture of a 50% solution of t-butyl peroctoate in mineral spirits (Lupersol PMS) in 4.0 pbw paraffinic base oil, were then added to the reaction vessel at 30 minute intervals, while maintaining the temperature of the reaction vessel contents at 105° C. Thirty minutes after the third initiator shot, 41.00 pbw 100N oil was added to the reaction vessel. The product so formed exhibited a polymer solids content of 53.35 wt %, a viscosity of 19,597 cSt at 210° F. Monomer conversion to polymer was calculated to be about 98%.

EXAMPLES 2–7

Poly(meth)acrylate copolymers were made.

80.11 grams of a mixture of 0.11 pbw of a 50% solution of 1,1-bis(t-butylperoxy)-3,3,5-trimethylcyclohexane, 92% purity (Lupersol 231 ) and 80.0 paraffinic neutral oil (100N Oil) was charged to a reaction vessel equipped in the manner described above in Example 1. The reaction vessel was then flushed with nitrogen and the contents of the vessel were heated to 115° C. and held at that temperature for 15 minutes. 410.07 grams of a monomer mixture consisting of 125.65 pbw cetyl-eicosyl methacrylate (95.5% purity), 224.49 pbw isodecyl methacrylate (98% purity), 40.0 pbw methyl methacrylate (100% 0 purity), 20.0 pbw hydroxypropyl methacrylate (100% purity), 0.40 pbw 1,1-bis(t-butylperoxy)-3,3,5-trimethylcyclohexane, 92% purity (Lupersol 231) and 0.16 pbw chain transfer agent (dodecyl mercaptan) was fed into the reaction vessel at a uniform rate over 90 minutes. The reaction vessel was cooled as needed during the monomer feed to maintain the reaction temperature at 115° C. The contents of the reaction vessel were held at 115° C. for 20 minutes following completion of the monomer feed. Three discrete shots of initiator, each consisting of 10.1 g of a mixture of 0.10 pbw of 1,1-bis(t-butylperoxy)-3,3,5-trimethylcyclohexane, 92% purity (Lupersol 231 ) in 1.0 pbw paraffinic base oil, were then added to the reaction vessel at 20 minute intervals, while maintaining the temperature of the reaction vessel contents at 115° C. Twenty minutes after the third initiator shot, 188.22 pbw 100N oil was added to the reaction vessel. The product so formed exhibited a polymer solids content of 48.64 wt %, a viscosity of 6772 cSt at 210° F. Monomer conversion to polymer was calculated to be about 97.3%.

The copolymers of Examples 3–7 were made by the same process as the copolymer of Example 2 except that different relative amounts of the respective alkyl methacrylate monomers were used as set forth below in Table 1. The compositions are set forth as the relative amounts of cetyl-eicosyl methacrylate (CEMA), isodecyl methacrylate (IDMA), methyl methacrylate (MMA) and hydroxypropyl methacrylate (HPMA).

TABLE 1

| Example No. | Composition CEMA/IDMA/MMA/HPMA (wt %) |
|---|---|
| 2 | 30/55/10/5 |
| 3 | 30/65/5/0 |
| 4 | 30/60/5/5 |
| 5 | 30/50/10/10 |
| 6 | 30/55/5/10 |
| 7 | 30/60/0/10 |

EXAMPLES 8–13

The concentrated polymer blend of Example 8, was made by mixing 10.40 pbw of the compatibilizer of Example 1 with 33.4 pbw of a solution of 15 wt % ethylene/propylene copolymer in oil (ECA-6941, Paramins), 43.40 pbw of the poly(meth)acrylate copolymer of Example 2 and 15.86 pbw of a hydrocarbon diluent (150N oil) at 100° C. with a pitched blade stirrer for two hours.

The blends of Examples 9–13 were made in the same manner as the blend of Example 8, using the respective polymethacrylate copolymers of Examples 3–7. The Example number the respective polymethacrylate copolymer (PMA Example No.), the wt % polymer solids of the respective polymethacrylate copolymer (PMA % Solids) and the respective amounts of polymethacrylate copolymer (PMA), compatibilizer, polyolefin copolymer and diluent, each expressed in grams, are set forth below in Table 2.

TABLE 2

| Blend Example No. | PMA Example No./PMA % Solids | PMA (grams) | Compatibilizer (grams) | Polyolefin Copolymer (grams) | Diluent (grams) |
|---|---|---|---|---|---|
| 8 | 2/46.92 | 21.70 | 5.2 | 16.7 | 7.93 |
| 9 | 3/44.62 | 22.81 | 5.2 | 16.7 | 8.69 |
| 10 | 4/36.32 | 28.03 | 5.2 | 16.7 | 0.00 |
| 11 | 5/44.16 | 23.05 | 5.2 | 16.7 | 6.58 |
| 12 | 6/48.46 | 21.01 | 5.2 | 16.7 | 8.62 |
| 13 | 7/47.07 | 21.63 | 5.2 | 16.7 | 8.00 |

EXAMPLE 14

Sample of each of the respective blends of Examples 8–13 and C2 were maintained at 100° C. for stability testing. The samples were visually inspected for evidence of phase separation on a daily basis for 99 days. The stability of each sample was characterized by noting the first appearance of phase separation.

The kinematic viscosity of each of the blends of Examples 8–13 was measured by the method of ASTM D445 and shear stability index of each of the blends of Examples 8–13 was measured by the method of ASTM D2603-91.

Results are set forth in Table 3 as Kinematic Viscosity (centiStokes), shear stability index (SSI) and Stability at 100° C. (days) for each blend.

TABLE 3

| Blend Example No. | PMA Example No. | Kinematic Viscosity (centiStokes) | SSI | Stability at 100° C. (days) |
|---|---|---|---|---|
| 8 | 2 | 3447 | 46.1 | 99+ |
| 9 | 3 | 616 | 27.5 | 1 |
| 10 | 4 | 1189 | 27.7 | 7 |
| 11 | 5 | 2220 | 33.6 | 21 |
| 12 | 6 | 994 | 26.7 | 2 |
| 13 | 7 | 756 | 23.9 | 1 |

The compatibilizer of the present invention stabilizes concentrated blends of otherwise thermodynamically incompatible non-nitrogenous dispersant poly(meth)acrylate copolymers and polyolefin copolymers in a hydrocarbon diluent.

The concentrated polymer blend of non-nitrogenous poly(meth)acrylate copolymer, polyolefin copolymer and compatibilizer of the present invention is useful as a dispersant viscosity improving additive for lubricating oils. The blend provides improved thickening efficiency compared to the poly(meth)acrylate copolymer alone, provides improved low temperature fluidity compared to the olefin copolymer alone and provides improved compatibility with fluoropolymer seals and gaskets compared to nitrogenous dispersant viscosity improving additives.

We claim:

1. A polymer blend, comprising:

an oil soluble diluent; and about 30 weight percent to about 50 weight percent polymer solids dispersed in the diluent, said polymer solids comprising:

from about 1 part by weight to about 20 parts by weight of an oil soluble olefinic copolymer;

from about 1 part by weight to about 20 parts by weight of a compatibilizer made by polymerizing, in an oil soluble diluent and in the presence of a polyolefin copolymer, a compatibilizer monomer mixture, comprising:

from about 0 weight percent to about 40 weight percent of a first monomer having the structural formula (a):

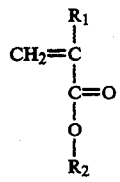

(a)

wherein:

each $R_1$ is independently H or $CH_3$; and each $R_2$ is independently selected from $(C_1-C_6)$alkyl;

from about 30 weight percent to about 90 weight percent of a second monomer having the structural formula (b):

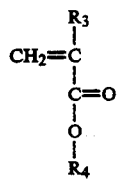

(b)

wherein:

each $R_3$ is independently H or $CH_3$; and each $R_4$ is independently selected form $(C_7-C_{15})$alkyl;

from about 0 weight percent to about 40 weight percent of a third monomer having the structural formula (c):

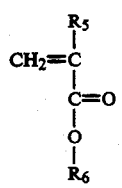

(c)

wherein each $R_5$ is independently H or $CH_3$; and each $R_6$ is independently selected from $(C_{16}-C_{24})$alkyl; and from about 2 weight percent to about 10 weight percent of a fourth monomer having the structural formula (d):

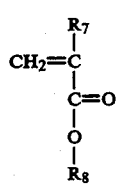

(d)

wherein each $R_7$ is independently H or $CH_3$; and each $R_8$ is independently selected from $(C_1-C_6)$hydroxyalkyl; and from about 20 parts by weight to about 60 parts by weight of an oil soluble alkyl (meth)acrylate copolymer, wherein the alkyl (meth)acrylate copolymer includes:

from about 0 weight percent to about 40 weight percent first repeating units derived from a monomer having the structural formula (a), wherein:

each $R_1$ is independently H or $CH_3$; and each $R_2$ is independently selected from $(C_1-C_6)$alkyl;

from about 30 weight percent to about 90 weight percent second repeating traits derived from a monomer having the structural formula (b), wherein:

each $R_3$ is independently H or $CH_3$; and each $R_4$ is independently selected from $(C_7-C_{15})$alkyl;

from about 0 weight percent to about 40 weight percent third repeating units derived from a monomer having the structural formula (c), wherein each $R_5$ is independently H or $CH_3$; and each $R_6$ is independently selected from $(C_{16}-C_{24})$alkyl; and from about 2 weight percent to about 10 weight percent fourth repeating units derived from a monomer having the structural formula (d), wherein each $R_7$ is independently H or $CH_3$; and each $R_8$ is independently selected from $(C_1-C_6)$hydroxyalkyl; and wherein the weight percent of fourth monomer in the compatibilizer monomer mixture is within 5 weight percent of the weight percent of fourth repeating units in the alkyl (meth)acrylate copolymer.

2. The polymer blend of claim 1, comprising about 40 weight percent to about 50 weight percent polymer solids.

3. The polymer blend of claim 1, wherein the alkyl (meth)acrylate copolymer comprises:

from about 0 wt % to about 25 wt % first repeating units;

from about 35 wt % to about 85 wt % second repeating units;

from about 5 wt % to about 35 wt % third repeating units; and from about 2 wt % to about 8 wt % fourth repeating units;

and wherein the compatibilizer monomer mixture comprises:

from about 0 wt % to about 25 wt % of the first monomer;

from about 35 wt % to about 85 wt % of the second monomer;

from about 5 wt % to about 35 wt % of the third monomer; and from about 2 wt % to about 8 wt % of the fourth monomer.

4. The polymer blend of claim 1, wherein the relative amount of fourth monomer in the compatibilizer monomer mixture is identical to the weight percent of fourth repeating units in the alkyl (meth)acrylate copolymer.

5. The polymer blend of claim 1, wherein the average number of carbon atoms in the alkyl and hydroxyalkyl substituents of the monomers of the compatibilizer monomer mixture agrees with the average number of carbon atoms in the alkyl and hydroxyalkyl substituents of the poly(meth)acrylate copolymer within ±0.5.

* * * * *